US005322290A

United States Patent [19]

Minami

[11] Patent Number: 5,322,290

[45] Date of Patent: Jun. 21, 1994

[54] GOLF CLUB GRIP

[75] Inventor: Masanobu Minami, Chiba, Japan

[73] Assignee: Maruman Golf Kabushiki Kaisha, Tokyo, Japan

[21] Appl. No.: 813,395

[22] Filed: Dec. 27, 1991

[30] Foreign Application Priority Data

Dec. 30, 1990 [JP] Japan ..... 2-405869[U]

[51] Int. Cl.[5] ..... A63B 69/36

[52] U.S. Cl. ..... 273/187.5; 273/81 B

[58] Field of Search ..... 273/81 B, 183 D, 183 R, 273/81.4, 81 R, 187.5, 187.4, 187.2, 186.2

[56] References Cited

U.S. PATENT DOCUMENTS

| | | | |
|---|---|---|---|
| 1,535,667 | 4/1925 | Horne | 273/81 B |
| 2,149,911 | 3/1939 | East | 273/81.4 |
| 2,205,769 | 6/1940 | Sweetland | 273/81.4 X |
| 3,198,520 | 8/1965 | Ahmuty | 273/81.4 |
| 4,819,939 | 4/1989 | Kobayashi | 273/81 R |
| 4,861,034 | 8/1989 | Lee | 273/81.4 X |
| 4,919,420 | 4/1990 | Sato | 273/81 B |
| 4,989,870 | 2/1991 | Janes | 273/73 D X |
| 5,088,734 | 2/1992 | Glava | 273/81 R X |

FOREIGN PATENT DOCUMENTS

| | | |
|---|---|---|
| 363003 | 12/1931 | United Kingdom . |
| 2182252 | 5/1987 | United Kingdom . |
| 2192550 | 1/1988 | United Kingdom . |

*Primary Examiner*—George J. Marlo
*Attorney, Agent, or Firm*—Armstrong, Westerman Hattori, McLeland & Naughton

[57] ABSTRACT

A golf club grip has a double-layer structure comprising an inner layer and an outer layer aminated on the outer surface of the inner layer. One of the inner and outer layers is made of a first material, while the other layer is made of a second material. The first material has an elasticity which is higher than that of the second material so that the first material is more readily elastically deformable than the second material, while the second material has a viscoelasticity which is higher than that of the first material.

3 Claims, 4 Drawing Sheets

FIG. 1
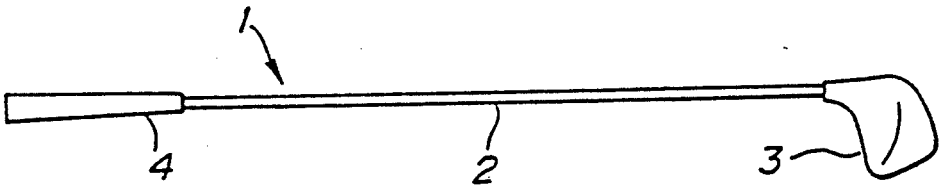
FIG. 2
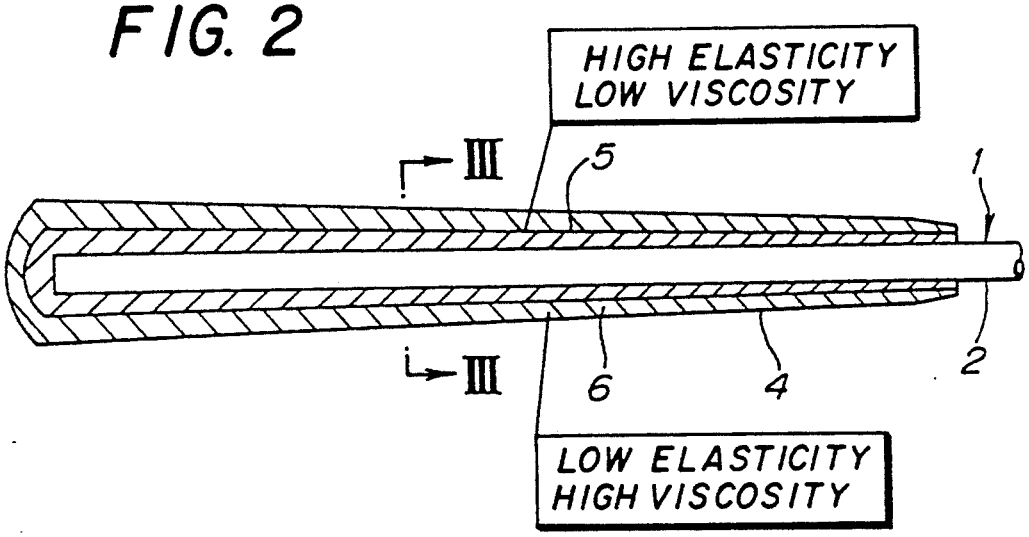
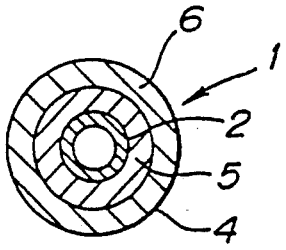
FIG. 3

FIG. 4
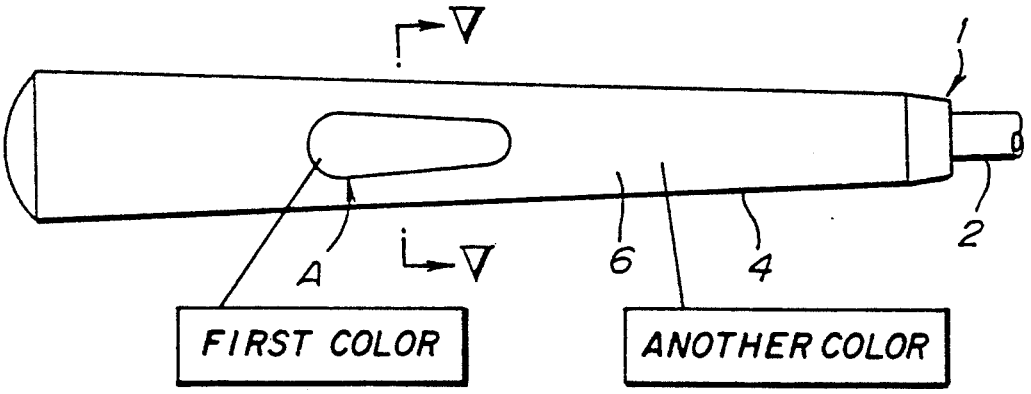
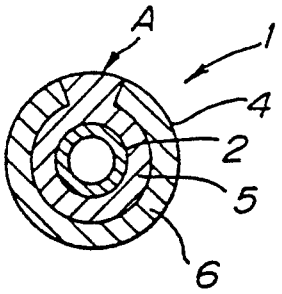
FIG. 5

GOLF CLUB GRIP

BACKGROUND OF THE INVENTION

1. Field of the Invention

The present invention generally relates to improvements in the golf club grip.

2. Description of Related Art

In playing golf, if the golf club grip is gripped with an excessive force, the ball can not fly over a large distance, and also it is difficult to accurately control the flying direction of the ball. In order to prevent the grip from being gripped with an excessive force, it is important to enhance the sense felt from the grip by the player, particularly the sense of fitness and sense of firmness when the grip is gripped. The term "sense of fitness" means a sense of touching the grip with the player's hands fitted therewith, and the term "sense of firmness" means a sense that the grip is gripped stably and reliably particularly when swinging the club. If either of these senses are lacking, the player is liable to grip the grip with an excessive gripping force due to a sense of instability.

It is thus desirable to construct the golf club grip so as to obtain both the sense of fitness and sense of firmness. With the prior art grip, however, it has been difficult to meet these demands at the same time.

For example, in a rubber grip the sense of fitness may be enhanced by using a rubber material having a low rubber hardness. To decrease the rubber hardness of the grip, however, causes the sense of firmness to be deteriorated. Contrarily, to increase the rubber hardness of the grip causes the sense of firmness to be increased. In this case, however, the sense of fitness will be deteriorated. Accordingly, in the prior art grip both the sense of fitness and sense of firmness can not be enhanced at the same time, that is, if it is intended to enhance either sense, the other sense is deteriorated.

Further, when swinging a golf club, the grip experiences a force tending to bring about its bending deformation, a force tending to bring about its torsional deformation with respect to its longitudinal axis and a tensile force tending to elongate it by pulling it in the direction of centrifugal force of the club. However, if the grip is actually greatly deformed by these forces, the player will tend to grip the grip with an excessive force due to the sense of instability. Therefore, the material of the grip should be selected to suppress the deformation of the grip as noted above as much as possible. With the prior art grip, however, it has been difficult to suppress the bending deformation, torsional deformation and elongative deformation at the same time.

SUMMARY OF THE INVENTION

A first object of the present invention is to provide a golf club grip, which makes it possible to enhance both the sense of fitness and sense of firmness at the same time.

A second object of the invention is to provide a golf club grip, which can suppress at the same time the bending deformation, torsional deformation and elongative deformation when swinging the club and thus enhance the sense of fitness felt by the player.

In order to achieve the first object of the invention, there is provided a golf club grip comprising an inner layer secured to a stem portion of a golf club shaft and an outer layer laminated on the outer surface of said inner layer, one of said inner and outer layers being made of a first material, while the other layer being made of a second material, wherein said first material has an elasticity which is higher than that of said second material so that said first material is more readily elastically deformable than said second material, while said second material has a viscoelasticity which is higher than that of said first material.

In order to achieve the same object, there is also provided a golf club grip comprising an inner layer secured to a stem portion of a golf club shaft and an outer layer laminated on the outer surface of said inner layer, one of said inner and outer layers having a rubber hardness which is higher than that of the other layer.

According to the above-mentioned constructions of the grip, both the senses of fitness and firmness when the grip is gripped can be enhanced at the same time.

In order to achieve the second object of the invention, there is provided a golf club grip comprising an inner layer secured to a stem portion of a golf club shaft and an outer layer laminated on the outer surface of said inner layer, wherein one of said inner and outer layers has a modulus of transversal elasticity which is higher than that of the other layer and a modulus of longitudinal elasticity which is lower than that of the other layer.

According to the above-mentioned construction, it is possible to suppress bending, torsional and tensile deformations of the grip when swinging the golf club and enhance the sense of firmness.

In the above-described structures, a portion of the inner layer of the grip may be exposed at the surface of the outer layer. With this construction, it is possible to determine the grip characteristic distribution along the grip in accordance with a pressure distribution provided by the player's hands or fingers and permit further enhancement of the senses of fitness and firmness.

In this case, the surface of the outer layer and the surface of the exposed portion of the inner layer may advantageously have different colors. In this construction, the exposed portion serves as a mark for positioning the player's hands or fingers on the grip, and thus it is possible to give the player a sense of easiness.

Further objects, features and advantages of the present invention will become apparent from the following description of the preferred embodiments of the present invention as illustrated in the accompanying drawings.

BRIEF DESCRIPTION OF THE DRAWINGS

FIG. 1 is a front view of a golf club with a grip embodying the present invention;

FIG. 3 is a sectional view of the grip taken along the line III—III in FIG. 2;

FIG. 4 is a front view showing a different embodiment of the grip; and

FIG. 5 is a sectional view of the grip taken along the line V—V in FIG. 4.

DESCRIPTION OF THE PREFERRED EMBODIMENTS

Figure 2A:
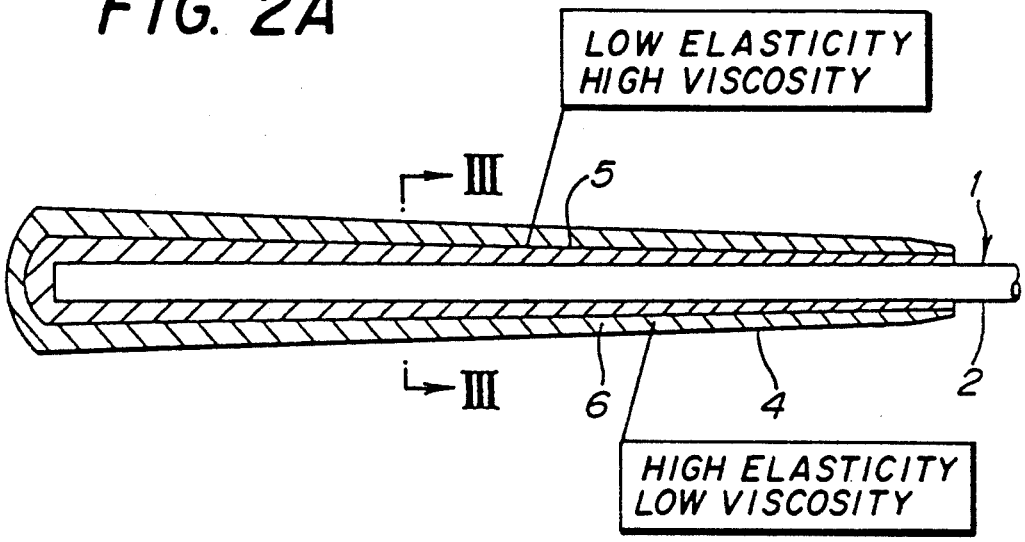
FIG. 2 is an enlarged sectional view in a grip section of the golf club.
Figure 2B:
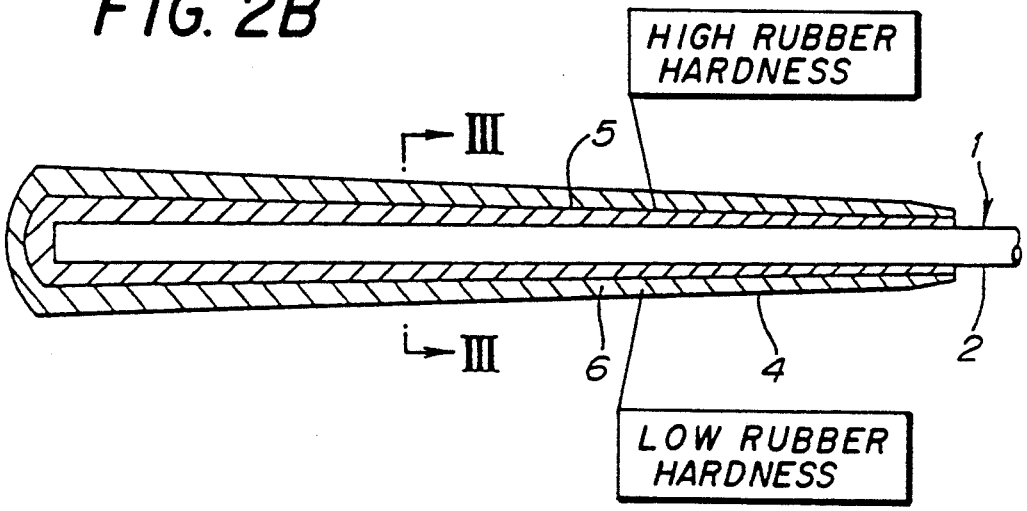
Figure 2C:
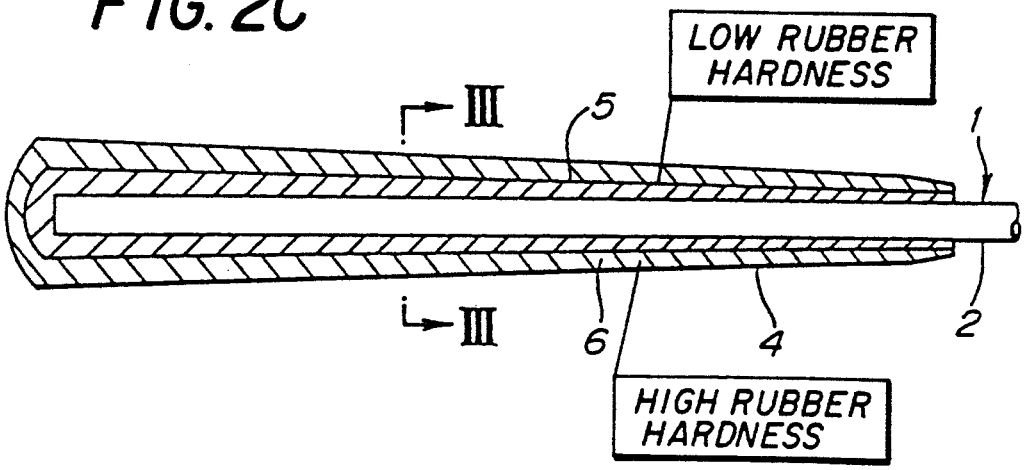
Figure 2D:
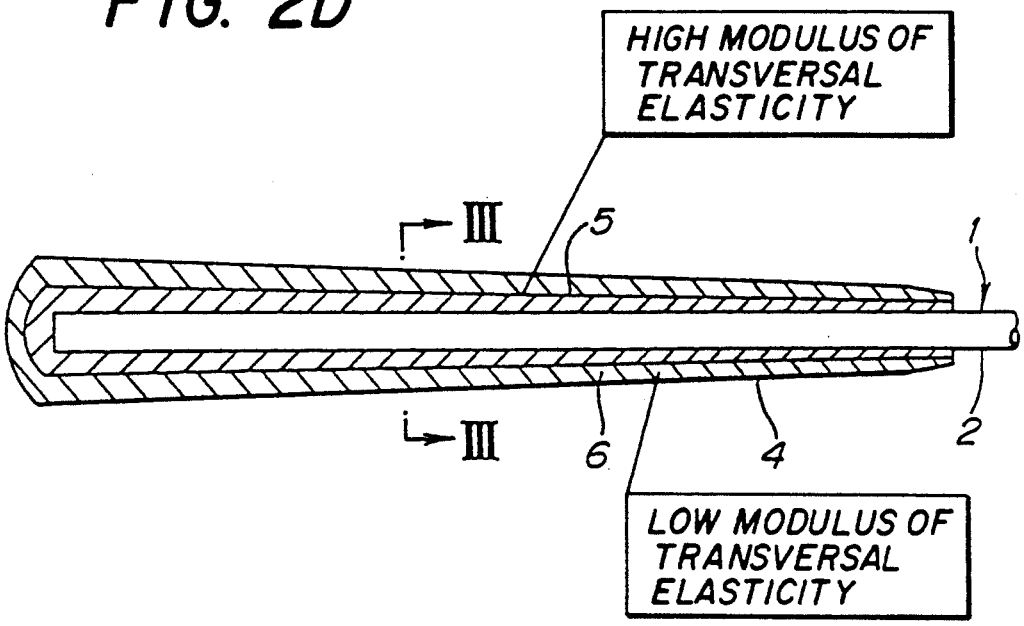
Figure 2E:
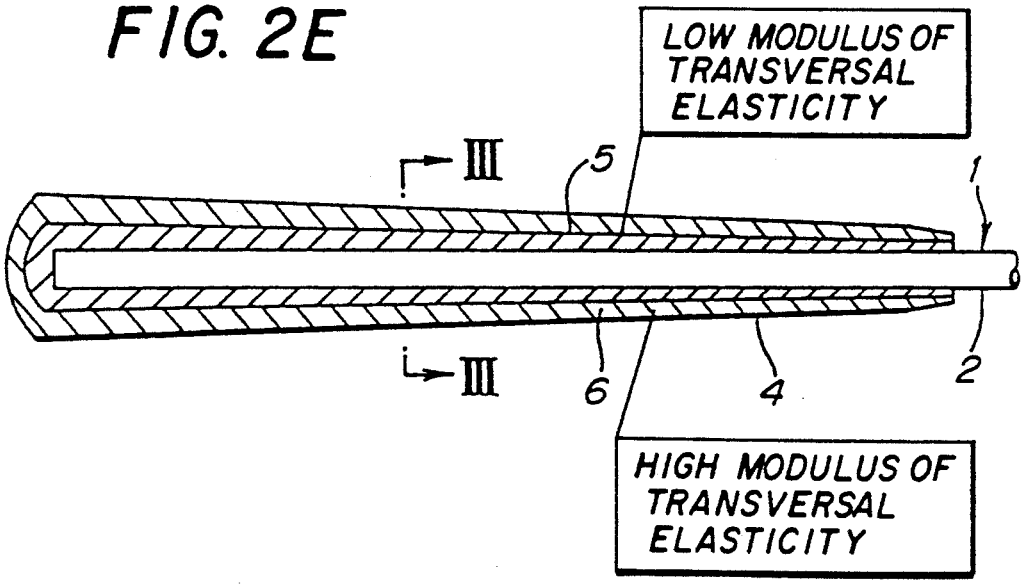

FIGS. 1 to 3 are views for explaining a first to third embodiments of the present invention. Referring first to FIG. 1, a golf club 1 comprises a club shaft 2, a head 3 secured to the fore end of the shaft and a tubular grip 4 secured to the stem of the shaft. As shown in FIGS. 2 and 3, the grip 4 according to the invention has a double-layered structure having an inner layer 5 secured to the stem of the club shaft 2 and an outer layer 6 laminated on the outer surface of the inner layer 5. The inner and outer layers 5 and 6 are made of elastic materials such as natural rubber, synthetic rubber or the like.

In the first embodiment of the invention, the inner layer 5 of the grip 4 is made of a first elastic material, while the outer layer 6 is made of a second elastic material which is different from the first elastic material. More particularly, the first elastic material has an elasticity which is higher than that of the second elastic material so that the first elastic material is more readily elastically deformable than the second elastic material, while the second elastic material has a viscoelasticity which is higher than that of the first material. In other words, the inner layer 5 has a superior elasticity, while the outer layer 6 has a superior viscosity.

Usually, a golf club grip having a superior elasticity provides and enhanced sense of fitness when it is gripped. On the other hand, a grip having a high viscoelasticity provides a sense of firmness when it is gripped. With the grip 4 in the first embodiment, when the grip 4 is gripped, the sense of fitness and sense of firmness can be enhanced at the same time, because the inner layer 5 has a superior elasticity while the outer layer 6 has a high viscoelasticity.

The prior art grip comprises a single layer or has a double-layered structure with the materials of the individual layers selected for the sole purpose of weight reduction. Thus, the prior art grip can not provide enhanced senses of fitness and firmness at the same time when the grip is gripped. In comparison to this, the grip 4 according to the the first embodiment of the invention, the individual layers 5 and 6 can provide respective functions of enhancing the sense of fitness and sense of firmness, thus meeting both the requirements at the same time.

Although in the first embodiment, the inner layer 5 is made readily elastically deformable while the outer layer 6 is provided with enhanced viscoelasticity, the same effects may be obtained by forming the outer layer 6 with a material capable of ready elastic deformation and forming the inner layer 5 with a material having a greater viscoelasticity than the outer layer 6.

In the second embodiment of the invention, the inner layer 5 of the grip 4 shown in FIGS. 2 and 3, is made of a first elastic material, while the outer layer 6 of the grip 4 is made of a second elastic material which is different in rubber hardness from the first elastic material. More particularly, the first elastic material has a rubber hardness which is higher than that of the second elastic material. Alternatively, the outer layer 6 may be made of a material having a rubber hardness which is higher than that of the inner layer 5.

Usually, when a grip having an increased rubber hardness is gripped with the player's hands or fingers, an enhanced sense of firmness can be obtained, and conversely with a reduced rubber hardness an enhanced sense of fitness can be obtained. With the construction of the second embodiment, an enhanced sense of firmness can be provided with one of the inner and outer layers 5 and 6 having a higher rubber hardness when the grip 4 is gripped, while an enhanced sense of fitness can be provided with the other layer having a lower rubber hardness. Thus, as similar to the aforementioned first embodiment, both the sense of fitness and sense of firmness can be enhanced at the same time.

In the third embodiment of the invention, the modulus of transversal elasticity of the inner layer 5 of the grip 4 shown in FIGS. 2 and 3 is set to be higher than that of the outer layer 6, while the modulus of longitudinal elasticity of the latter is set to be higher than that of the former. Alternatively, the modulus of transversal elasticity of the outer layer 6 may be set to be higher than that of the inner layer 5, while the modulus of longitudinal elasticity of the latter is set to be higher than that of the former. That is, one of the inner and outer layers 5 and 6 of the grip 4 according to the third embodiment is made of a first material having a higher modulus of transversal elasticity while the other layer is made of a second material having a higher modulus of longitudinal elasticity.

Usually, with increased modulus of longitudinal elasticity of the grip, the elongative deformation of the grip caused by the tensile force exerted thereto can be suppressed, and the bending hardness of the grip is increased. Accordingly, the bending deformation caused by a bending force can be suppressed. Further, with increased modulus of transversal elasticity of the grip, torsional deformation of the grip caused by a torsional force exerted thereto can be suppressed.

As aforementioned, when swinging a golf club, the grip experiences a force tending to bring about its bending deformation, a force tending to bring about its torsional deformation with respect to its axis and a tensile force tending to elongate it in the direction of centrifugal force of the club. However, since one of the inner and outer layers 5 and 6 of the grip 4 according to the third embodiment is made of a first material having a higher modulus of transversal elasticity while the other layer is made of a second material having a higher modulus of longitudinal elasticity, it is possible to suppress bending, torsional and elongative deformations of the grip when swinging the golf club 1 and, thus, enhance the sense of firmness.

When the grip 4 of the golf club 1 is gripped with the player's hands or fingers, the distribution of pressure provided thereon is uneven. Therefore, it is advantageous to distribute suitably the characteristics of grip 1 such as modulus of elasticity, viscoelasticity and rubber hardness in accordance with the distribution of pressure applied to the grip 1 from the player's hands or fingers.

FIGS. 4 and 5 are views for explaining fourth and fifth embodiments of the invention. In these Figures, the same or similar constituent elements as those in the first to third embodiments are denoted by the same reference numerals.

In the fourth embodiment, the inner layer 5 has an exposed portion A which is exposed at the surface of the outer layer 6 of the grip 4, as shown in FIGS. 4 and 5. With this construction, it is possible to adjust the characteristics of the surface of the grip 4 to a most suitable state in accordance with the pressure distribution provided applied thereon from the player's hands when gripping the grip 4. The location and size of the exposed portion A of the inner layer 5 can be determined experimentally by taking the actual pressure distribution applied thereon from the player's hands when gripping the grip 4, as well as differences among individuals, into considerations to obtain the most superior sense of fitness and sense of firmness.

Where the inner layer 5 is partly exposed at the surface of the grip 4 as shown in FIGS. 4 and 5, the surface of the outer layer 6 and the surface of the exposed portion A of the inner layer 5 may be provided with different colors. This arrangement permits the player to determine instantly the positions of the hands or fingers to be located on the grip 4 so as to obtain the most superior sense of fitness and firmness. That is, a mark can be made by providing different colors on the surface of the outer layer 6 and the surface of the exposed portion A of the grip 4, respectively. Such mark serves to locate suitably the player's hands or fingers on the grip 4 of the club 1 and, thus, gives the player a sense of easiness. With such easiness sense, the player can exhibit the utmost ability. That is, the player can exhibit the ability owing to a sort of hint provided by the mark.

While the invention has been described in conjunction with specific embodiments thereof, it is evident that many alternatives and modifications will be apparent to those skilled in the art in light of the foregoing description. Accordingly, it is intended to include all such alternatives and modifications as fall within the spirit and scope of the appended claims.

What is claimed is:

1. A golf club grip for use on a golf club comprising an inner layer for securing said grip to a stem portion of a golf club shaft and an outer layer laminated to an outer surface of said inner layer, said inner layer being made of a first elastic material, while said outer layer is made of a second elastic material, wherein said first elastic material is more readily elastically deformable than said elastic second material in order to enhance, for the golfer using a golf club with said grip thereon, a sense of fitness, while said second material has a viscoelasticity which is higher than that of said first elastic material so that said second elastic material can enhance, for the golfer using a golf club with said grip thereon, a sense of firmness.

2. The golf club grip according to claim 1, wherein said inner layer has an exposed portion which is exposed at the surface of said outer layer.

3. The golf club grip according to claim 2, wherein the surface of said outer layer and the surface of said exposed portion of said inner layer have different colors.

* * * * *